US011517923B2

(12) United States Patent
Hartzler et al.

(10) Patent No.: US 11,517,923 B2
(45) Date of Patent: Dec. 6, 2022

(54) APPLICATION SYSTEM

(71) Applicant: Roof Equipment LLC, Belleville, PA (US)

(72) Inventors: Benjamin B. Hartzler, Belleville, PA (US); Jeffrey Zook, Belleville, PA (US); Jeremy Suydam, Belleville, PA (US)

(73) Assignee: Roof Equipment LLC, Belleville, PA (US)

( * ) Notice: Subject to any disclaimer, the term of this patent is extended or adjusted under 35 U.S.C. 154(b) by 191 days.

(21) Appl. No.: 16/922,527

(22) Filed: Jul. 7, 2020

(65) Prior Publication Data

US 2021/0031219 A1 Feb. 4, 2021

Related U.S. Application Data

(60) Provisional application No. 62/880,349, filed on Jul. 30, 2019.

(51) Int. Cl.

| | |
|---|---|
| ***B05B 7/00*** | (2006.01) |
| ***B05B 12/32*** | (2018.01) |
| ***E04D 15/00*** | (2006.01) |

(52) U.S. Cl.

CPC ..... *B05B 7/0093* (2013.01); *B05B 12/32* (2018.02); *E04D 15/00* (2013.01)

(58) Field of Classification Search

None

See application file for complete search history.

(56) References Cited

U.S. PATENT DOCUMENTS

| | | | | | |
|---|---|---|---|---|---|
| 4,267,973 | A * | 5/1981 | Stewart | E01C 23/22 | 239/176 |
| 4,535,920 | A * | 8/1985 | Troup | B05C 5/02 | 222/536 |
| 4,624,602 | A * | 11/1986 | Kieffer | E01C 23/22 | 239/176 |
| 4,861,190 | A * | 8/1989 | Glassel | E01C 23/22 | 404/93 |
| 4,877,348 | A * | 10/1989 | Opie | E01C 23/22 | 404/93 |
| 4,893,751 | A * | 1/1990 | Armstrong | E01C 23/22 | 239/176 |
| 5,302,207 | A * | 4/1994 | Jurcisin | E01C 23/22 | 118/305 |

(Continued)

*Primary Examiner* — Jethro M. Pence

(74) *Attorney, Agent, or Firm* — McNees Wallace & Nurick

(57) ABSTRACT

An application system for applying a substance over a predetermined surface includes a frame movable over the predetermined surface, a pressurized carrier source, a vessel containing the substance. The system further includes a first conduit for conveying the substance from the vessel to at least one nozzle and a second conduit for conveying a pressurized carrier from the pressurized carrier source to the at least one nozzle for applying a mixture of the pressurized carrier and the substance over the predetermined surface. The system further includes a cover laterally surrounding the at least one nozzle for minimizing overspray of the mixture, the frame carrying the pressurized carrier source, the vessel, the first conduit, the second conduit, and the cover.

20 Claims, 4 Drawing Sheets

(56) References Cited

U.S. PATENT DOCUMENTS

| | | | | |
|---|---|---|---|---|
| 7,140,555 | B1 * | 11/2006 | Bricko | B05B 15/62 239/113 |
| 7,150,413 | B1 * | 12/2006 | Bricko | B05B 9/0403 404/93 |
| 7,367,515 | B1 * | 5/2008 | Newman | E01C 23/22 404/93 |
| 7,611,076 | B1 * | 11/2009 | Street | B05B 15/55 404/93 |
| 9,644,331 | B2 * | 5/2017 | Vanneman | G02B 23/00 |
| 10,213,801 | B2 * | 2/2019 | Lim | B05B 13/005 |
| 10,214,926 | B2 * | 2/2019 | Lim | F16B 47/00 |
| 11,110,475 | B2 * | 9/2021 | Hegeman | B05B 13/005 |
| 11,148,161 | B2 * | 10/2021 | Ferguson | B05B 9/0403 |
| 11,255,053 | B2 * | 2/2022 | Vizcaino | C09D 7/40 |
| 2015/0330039 | A1 * | 11/2015 | Vanneman | G01B 11/272 356/400 |
| 2017/0043361 | A1 * | 2/2017 | Smuin | B05B 7/2494 |

* cited by examiner

APPLICATION SYSTEM

CROSS REFERENCE TO RELATED APPLICATIONS

This application relates to and claims the benefit of U.S. Patent Application No. 62/880,349, filed Jul. 30, 2019, entitled "SPRAY CART," the disclosures of which are incorporated by reference in their entirety.

FIELD OF THE INVENTION

The present invention is directed to spraying a substance, such as an adhesive over a large surface, such to adhere roofing materials.

BACKGROUND OF THE INVENTION

Flat roofs often utilize rolls of ethylene propylene diene terpolymer (EPDM) and thermoplastic polyolefin (TPO) roofing materials, sometimes referred to as rubber roofing. The process for applying adhesive, such as foam adhesive for installing these materials over the flat roof surface is outlined in the manufacturer's specifications. Prior application methods have utilized multiple roofers to each spray one small path of adhesive at a time while an additional worker pulls the canisters alongside. This arrangement substantially increases the number of manhours for a given job. Additionally, the use of multiple roofers spraying individually results in potential inconsistent spray patterns/depths, and even gaps of coverage, as the inconsistencies lead to adhesive canisters emptying at varied rates. The same can be said of other large surfaces where adhesive is used (warehouses, box stores, etc.), though the description herein focuses primarily on roofing applications. To install a roll of rubber roofing on large, flat roof areas, adhesive must first be sprayed evenly, side to side over the supporting surface to be covered/protected, the spray nozzle held approximately 12 inches above the material. The roofers spraying adhesive begin at one end of the area being sprayed, and walk backwards away from the one end, staying in stride with the other roofers spraying the adhesive, as well as the person pulling the cart carrying the foam canisters. The result of the spray foam application is dependent on factors including, but not limited to, the roofers' training, experience, accuracy, competency, and fatigue level.

What is needed is an apparatus or system that can be easily used to create a uniform application of the adhesive according to manufacturer's standards, while maximizing productivity and minimizing the labor-intense and time-consuming process currently employed by the construction industry (roofing, flooring, sealing, etc.).

BRIEF DESCRIPTION OF THE INVENTION

In an exemplary embodiment, an application system for applying a substance over a predetermined surface includes a frame movable over the predetermined surface, a pressurized carrier source, a vessel containing the substance. The system further includes a first conduit for conveying the substance from the vessel to at least one nozzle and a second conduit for conveying a pressurized carrier from the pressurized carrier source to the at least one nozzle for applying a mixture of the pressurized carrier and the substance over the predetermined surface. The system further includes a cover laterally surrounding the at least one nozzle for minimizing overspray of the mixture, the frame carrying the pressurized carrier source, the vessel, the first conduit, the second conduit, and the cover.

In another exemplary embodiment, an application system for applying a substance over a predetermined horizontal support surface including a frame movable over the predetermined horizontal support surface, an air compressor, and a vessel containing the substance. The system further includes a first conduit for conveying the substance from the vessel to at least one nozzle and a second conduit for conveying pressurized air from the air compressor to the at least one nozzle for applying a mixture of the pressurized air and the substance over the predetermined horizontal support surface. The system further includes a cover laterally surrounding the at least one nozzle for minimizing overspray of the mixture, and the frame carrying the air compressor, the vessel, the first conduit, the second conduit, and the cover. The system is self-contained.

In yet another exemplary embodiment, an application system for applying a roofing adhesive or a roofing sealant over a predetermined horizontal support surface includes a frame movable over the predetermined horizontal support surface, the frame including a pair of wheels rotatably connected to the frame at opposed sides at one end of the frame, an air compressor, a vessel containing the roofing adhesive or the roofing sealant, a heater positioned over at least a portion of the vessel for controlling the temperature of the roofing adhesive or the roofing sealant, a first conduit for conveying the roofing adhesive or the roofing sealant from the vessel to a plurality of nozzles and a second conduit for conveying pressurized air from the air compressor to the plurality of nozzles for applying a mixture of the pressurized air and the roofing adhesive or the roofing sealant over the predetermined horizontal support surface, and a cover laterally surrounding the plurality of nozzles for minimizing overspray of the mixture, the cover defining a closed periphery having a plurality of flexible members extending in proximity to the predetermined horizontal support surface during operation of the system, wherein the frame carries the air compressor, the vessel, the first conduit, the second conduit, and the cover, the cover and the plurality of nozzles are movable relative to the frame between an operating position and a first transport position, the plurality of nozzles is in a linear arrangement at a fixed predetermined distance from the predetermined horizontal support surface in the operating position, and the system is self-contained.

Other features and advantages of the present invention will be apparent from the following more detailed description of the preferred embodiment, taken in conjunction with the accompanying drawings, which illustrate, by way of example, the principles of the invention.

BRIEF DESCRIPTION OF THE DRAWINGS

Wherever possible, the same reference numbers will be used throughout the drawings to represent the same parts.

DETAILED DESCRIPTION OF THE INVENTION

A shown in FIGS. 1-4, an application system 10 of the present invention includes a frame 11 for supporting system components, and uses a pressurized carrier, such as air to operate a plurality of spray nozzles 12, such as (six spray nozzles 12 (FIG. 1) to dispense a substance from pressurized canisters or pressurized vessels or vessels 14, 16. The substance may be any suitable substance, including, but not limited to, an adhesive, a roofing adhesive, a liquid protective material, a roofing liquid protective material, a roofing sealant, and combinations thereof. As used herein, a "roofing adhesive" refers to an adhesive for adhering roofing materials during roof installation, and a "roofing sealant" refers to a sealant for sealing roofing materials.

Figure 1:
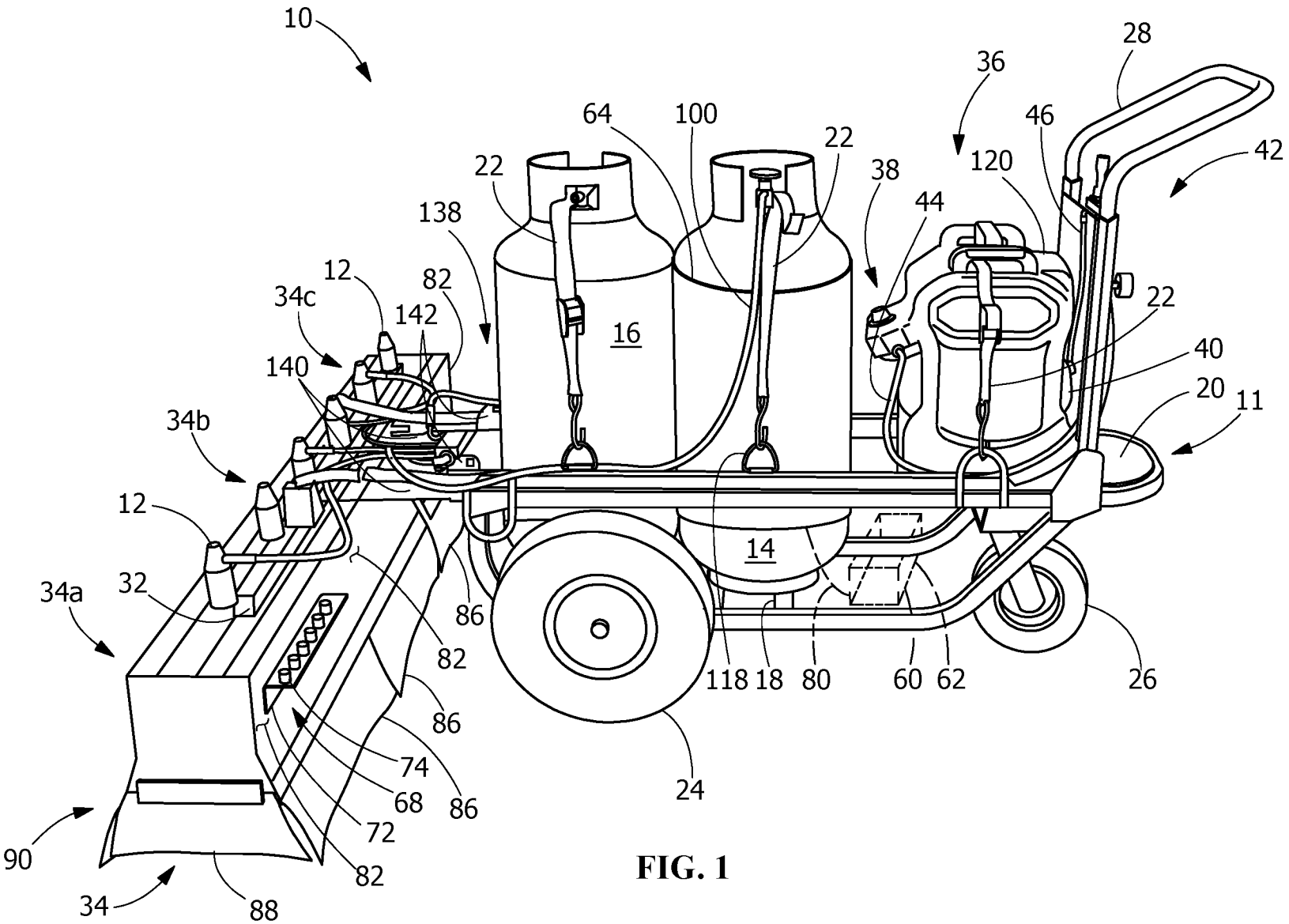
FIG. 1 is a top-side perspective view of an application system, according to an embodiment of the present disclosure.

As shown in FIG. 1, spray nozzles 12 are positioned at a predetermined height above a support surface 30 and a predetermined spacing (typically a uniform spacing between adjacent spray nozzles 12) relative to one another along a support arm or support member 32 (FIG. 2) that is secured to one end of frame 11. In one embodiment, a plurality of spray nozzles 12 are positioned at the same fixed predetermined height above the support surface 30 such that the substance distributed from the nozzles 12 forms a sprayed layer having a substantially uniform thickness across the width of the sprayed layer. As used herein, "substantially uniform" indicates a thickness variance of less than 10%, excepting any irregularities in the support surface 30. In one embodiment, support member 32 extends linearly, with the spray nozzles 12 supported by support member 32 also being linearly arranged. As further shown in FIG. 1, frame 11 supports a cover 34 that laterally surrounds the plurality of spray nozzles 12. As shown, cover 34 comprises a plurality of cover portions 34*a*, 34*b*, 34*c*, each cover portion including a pair of opposed rigid panels 82, with cover portions 34*a*, 34*c* each including an end panel 84 positioned between adjacent panels 82 (only one panel 82 of cover portions 34*a*, 34*b*, 34*c* and panel 84 of cover portion 34*a* is shown in FIG. 1). Each panel 82, 84 supports at one end a respective flexible member 86, 88 such that the end of the flexible members 86, 88 opposite their respective panels 82, 84 are positioned in close proximity with support surface 30, with panels 82, 84 and flexible members 86, 88 collectively forming a generally continuous closed periphery during operation of the system that is suspended above support surface 30 for preventing overspray of adhesive from the spray nozzles 12 positioned adjacent to cover 34, such as during windy conditions. As shown in FIG. 1, support arm or support member 32 (FIG. 2) is linear and extends transverse to the direction of travel of wheels 24 and caster 26, when wheels 24 and caster 26 are in mutual alignment. In one embodiment, vessels 14, 16 may be the same size. In one embodiment, one of vessels 14, 16 are sized differently from one another.

Figure 2:
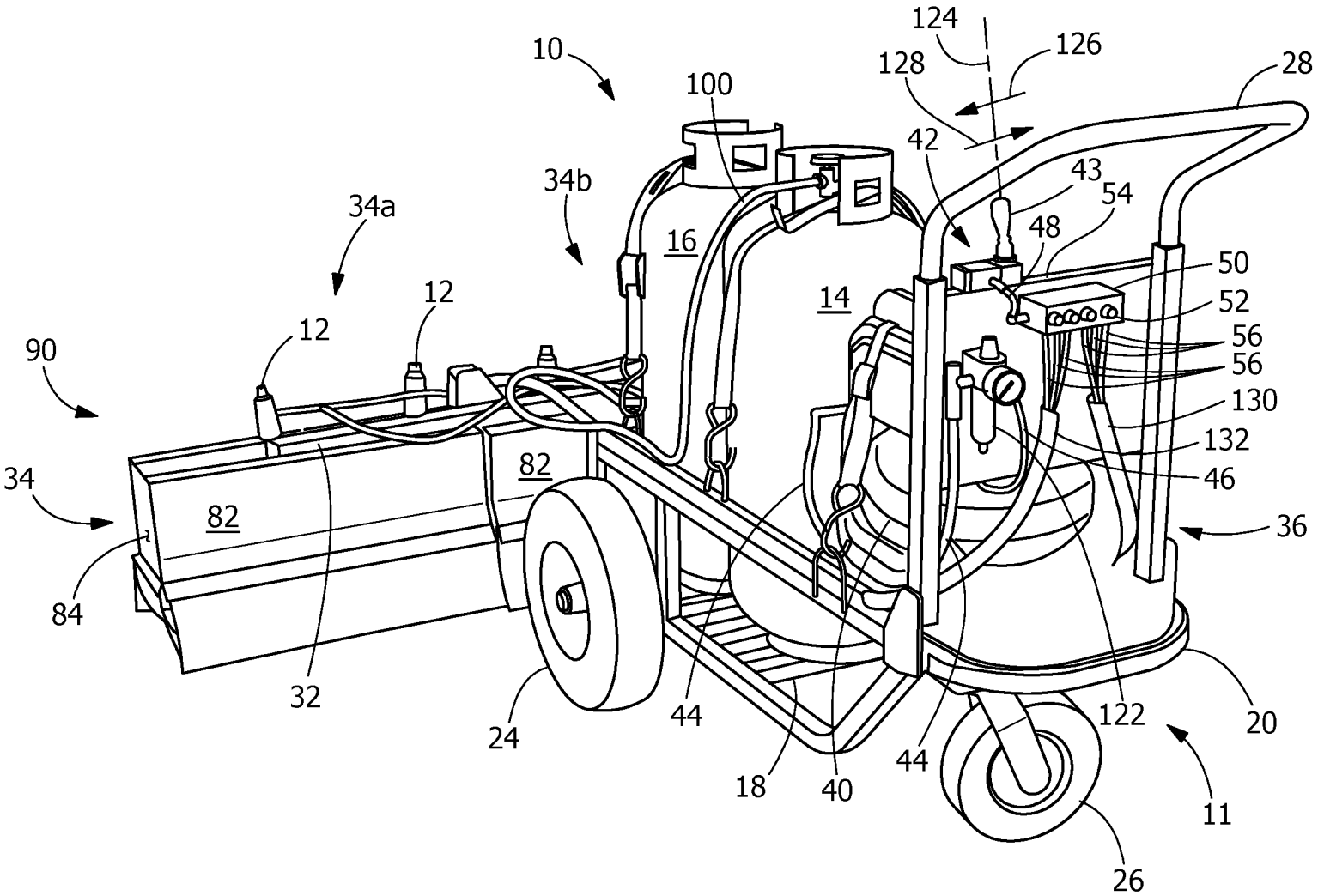
FIG. 2 is a top-side-rear perspective view of the application system of FIG. 1.
Figure 3:
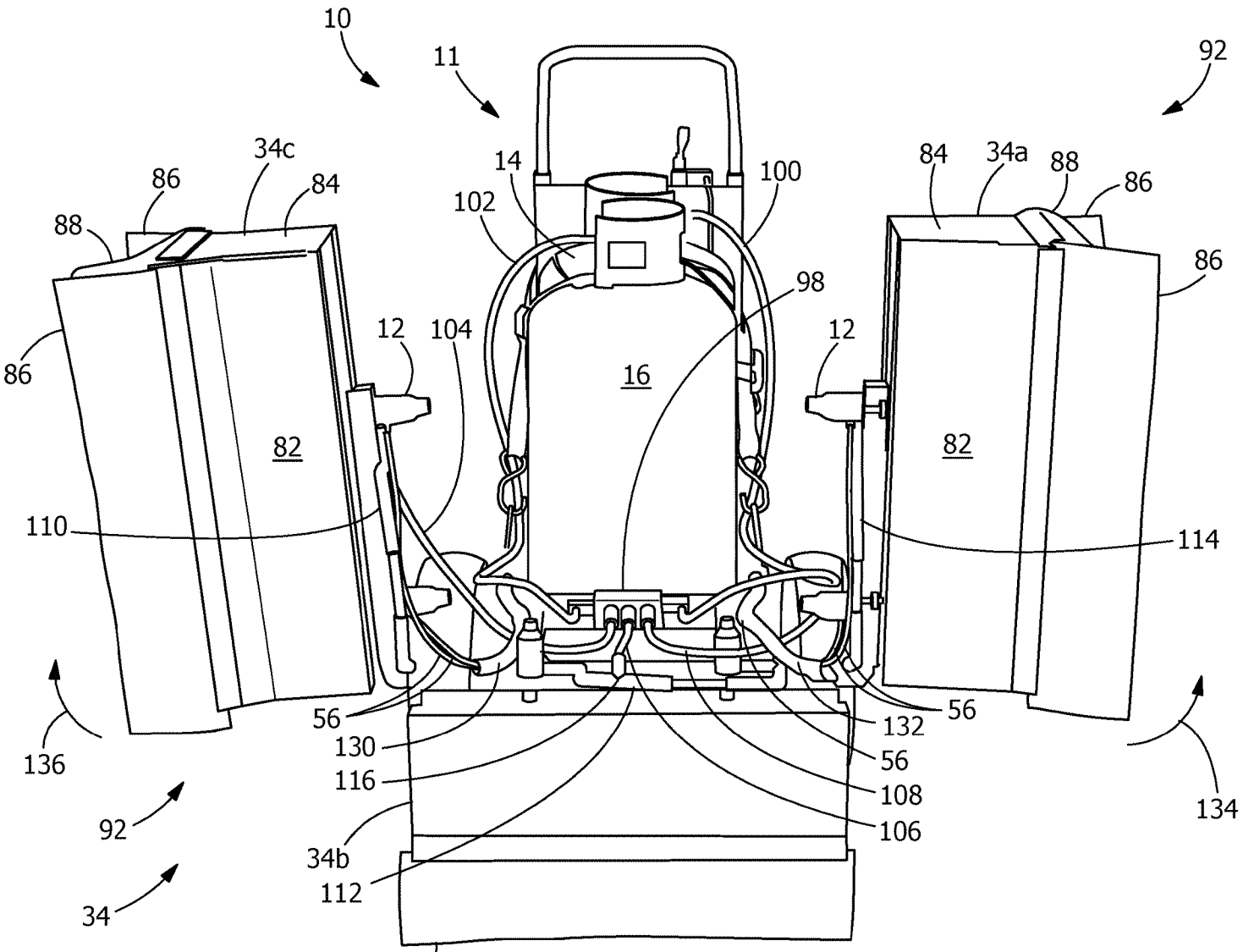
FIG. 3 is a top-front perspective view of the application system of FIG. 1 in a first transport position.

As shown in FIG. 3, cover 34 may be manipulated between an operating position 90 (FIG. 1) to a first traveling position 92 (FIG. 3) as a result of rotating each of cover portion 34*a* in rotational movement direction 134 and cover portion 34*c* in rotational movement direction 136 approximately 90 degrees about respective pivotable connections 96 (FIG. 2) positioned at each of the opposed ends of cover portion 34*b* (FIG. 2 shows the pivotable connection 96 usable to rotate cover portion 34*a*).

Figure 4:
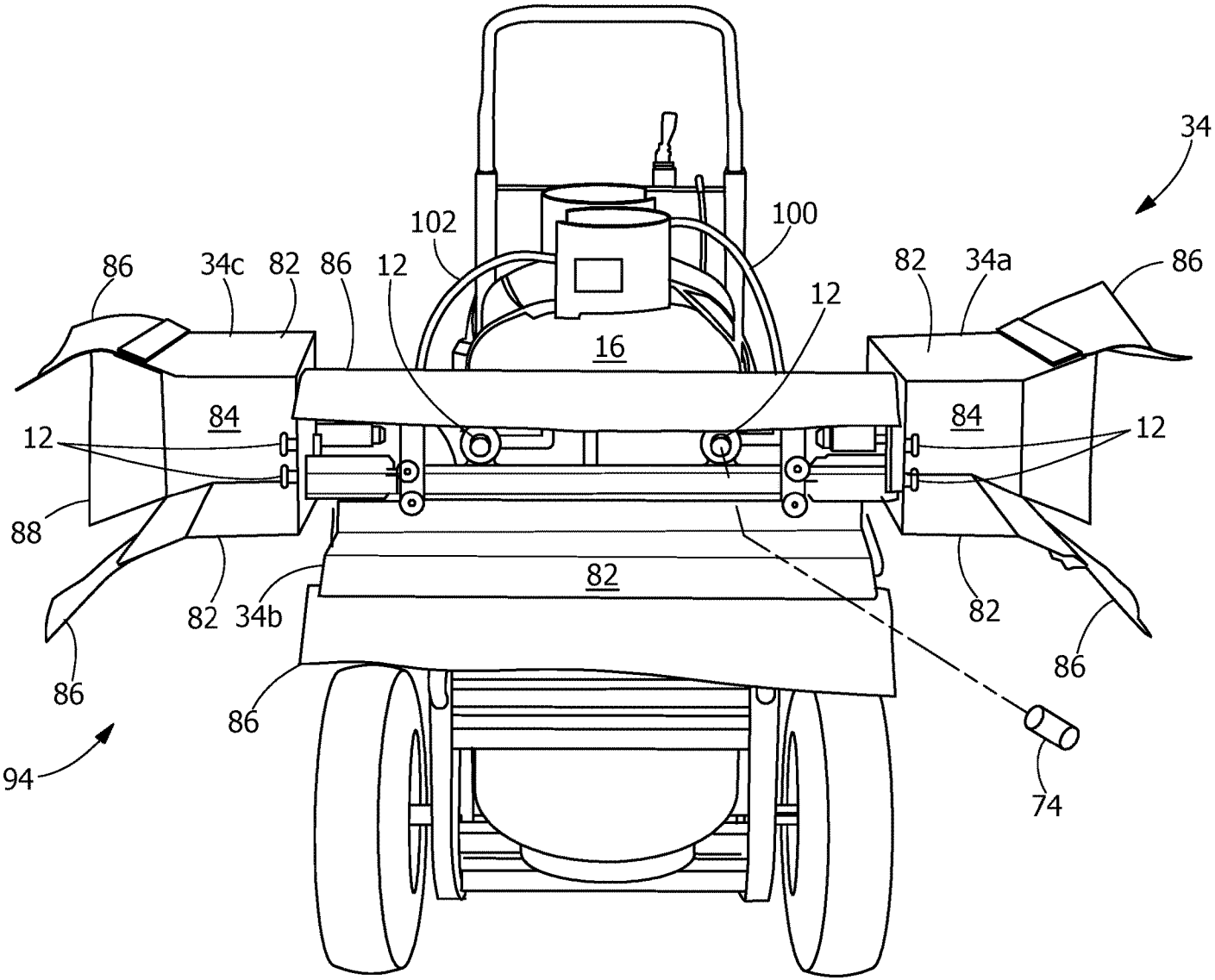
FIG. 4 is a top-front perspective view of the application system of FIG. 1 in a second transport position.

As shown in FIG. 4, cover 34 may then be manipulated from first traveling position 92 (FIG. 3) to a second traveling position 94 as a result of collectively rotating cover 34 and frame portions 140 (FIG. 1) about respective pivotable connections 138 (FIG. 1) approximately 90 degrees relative to respective the remaining portion of frame 11 (FIG. 1 shows the pivotable connection 138 (FIG. 1) usable to rotate cover portion 34*a*). As shown in FIG. 1, optionally, pivotable connections 138 include a cutout 142 such as a square cutout adapted to receive an end of a torque drive bar (not shown) usable to assist with collectively rotating cover 34 and frame portions 140 between first traveling positions 92 (FIG. 3) and second traveling position 94 (FIG. 4). Rotating cover 34 and frame portions 140 to second traveling position 94 (FIG. 4) provides additional vertical clearance above support surface 30 for more easily transporting the system between job locations.

In use, as shown in FIG. 3, the exemplary embodiment of system 10 enables a single operator, which includes guiding frame 11, to apply adhesive on a roof application in the same amount of time that it currently takes seven people. Other systems currently in use have simply been designed to hold the canisters or vessels, but do not include the capability of applying the adhesive. In one embodiment, system 10 holds multiple vessels (such as two-four, 80-lb canisters or vessels, depending on the model) that typically are sufficient to adhere 20 squares (SQ) of rolled material (2,000 SF) per canister or vessel before needing to be replaced or switched out. Therefore, a two-canister or vessel cart will cover 40 SQ of rolled material (or 4,000 SF), and a four-canister or vessel cart will cover 80 SQ of rolled material (or 8,000 SF). In one embodiment as shown, one end of a manifold 98 receives adhesive from canister or vessel 14 via line or conduit 100 and the other end of manifold 98 receives adhesive from canister or vessel 16 via line or conduit 102. A line or conduit 104 connected to manifold 98 is connected via a tee fitting (not shown) to plumbing 110 interconnecting spray nozzles 12 corresponding to cover portion 34*c*. A line or conduit 106 connected to manifold 98 is connected via a tee fitting 116 to plumbing 112 interconnecting spray nozzles 12 corresponding to cover portion 34*b*. A line or conduit 108 connected to manifold 98 is connected via a tee fitting (not shown) to plumbing 114 interconnecting spray nozzles 12 corresponding to cover portion 34*a*. In this embodiment, the six (6) nozzles 12 may spray a 5-foot swath of adhesive. An extended system frame holds four canisters or vessels, which uses 12 nozzles to spray a 10-foot swath of adhesive. It is to be understood that other systems can hold different amounts of canisters or vessels than two or four, including more than four canisters or vessels, can utilize a different number of spray nozzles than six, including more than six spray nozzles, and that differently sized nozzles both larger and smaller than that described above may be used.

As shown in FIGS. 1 and 2, spray cart 10 includes a pair of support surfaces 18, 20 supporting canisters 14, 16 or other components. Optionally, for purposes of stability and safety, retainers 22 such as an adjustable strap are secured by frame 11 such as by an eyelet 118 to secure a corresponding canister or vessel 14, 16 or a pressurized carrier source 36 such as an air compressor to frame 11. A pair of wheels 24 may be rotatably connected to frame 11 at opposed sides at one end of frame 11, with a caster 26 rotatably connected to frame 11 at a generally central position at the opposed end of the frame to provide stability as well as enhanced manipulation and control by an operator (not shown) controllably guiding or moving the frame over support surface 30 as a result of force(s) applied to a handle 28 of the frame by the operator.

As shown in FIG. 1, pressurized carrier source 36, such as an air compressor, for example, manufactured by Dewalt that is headquartered in Towson, Md., includes a pressure regulator 38 associated with or integrated into pressurized carrier source 36 that initially regulates pressurized air which is stored in a tank 40 for use during operation of system 10. Pressurized carrier source 36 includes a power source 120 such as a battery or other source such as propane. In one embodiment, in which pressurized cannisters or vessels 14, 16 contain adhesive, pressurized cannisters or vessels 14, 16 do not require pressurized air from tank 40. In one embodiment, pressurized cannisters or vessels 14, 16 may require pressurized air from tank 40.

As further shown in FIG. 2, upon input from an operator (not shown), a control assembly 42 controls operation of system 10, in which pressurized air in tank 40 initially regulated by regulator 38 is conveyed via a line or conduit 44 to a pressure regulator 122, which further regulates the pressurized air that is then conveyed via line or conduit 46 to control assembly 42 before being controllably conveyed via line or conduit 48 to manifold 50. In one embodiment, such as shown in FIG. 2, control assembly 42 includes a control handle 43 that employs an on/off toggle. For example, in the embodiment, actuating or rotating or "tilting" control handle 43 in a left-hand biased direction 126 from a vertical position 124 prevents the flow of pressurized air to manifold 50, while actuating or rotating or "tilting" control handle 43 in a right-hand biased direction 128 from vertical position 124 provides the flow of regulated pressurized air from tank 40 to manifold 50. Manifold 50 includes a plurality of fittings or connectors 52 each connected to a corresponding line or conduit 56 for conveying regulated pressurized air to a corresponding spray nozzle 12 (FIG. 3). As shown, one grouping of conduits 56 is contained in a protective wrapping 130, and another grouping of conduits 56 is contained in a protective wrapping 132. As further shown in FIG. 2, each connector 52 includes a switch 54, permitting selective conveyance of regulated pressurized air to each corresponding spray nozzle 12 (FIG. 3), such as in situations not requiring operation of all of the spray nozzles 12. As shown in FIG. 3, each spray nozzle 12 receives pressurized air via a corresponding line 56, in addition to each spray nozzle 12 receiving adhesive in a manner as previously discussed.

Frame 11 carries all components required for operation of the system, including all power requirements, as well as the substance to be applied. As a result, the system is self-contained.

Optionally, FIG. 1 shows a storage area 68 for storing spray nozzle protectors 74 when the system is in use. When the system is not in use, spray nozzle protectors are installed over the ends of nozzles 12 (as schematically shown in FIG. 4) to prevent adhesive from curing on the tips of spray nozzles 12. As shown, storage area 68 includes a bracket 72 that is secured to cover portion 34*a* for receiving spray nozzle protectors 74 during operation of the system. Spray nozzle protectors 74 are adapted for storing a solvent (not shown) that prevents the adhesive from curing or "drying out." During periods of non-use of the system, spray nozzle protectors 74 are moved from bracket 72 and positioned over the tips of the spray nozzles 12 so that the tips of the spray nozzles 12 are sufficiently immersed in the solvent such that the adhesive is prevented from curing in the spray nozzles.

Optionally, as shown in FIG. 1, an electrical generator 60 is powered by a fuel/power source 62 such as a battery or a pressurized cannister containing propane or other suitable fuel. The electrical power is conveyed via line or conduit 80 from electrical generator 60 to a heater 64 such as a band containing heating elements that convert electrical energy into heat. Heater 64 may be used to raise the temperature of the adhesive in cannisters or vessels 14, 16 to a suitable operating temperature, such as about 80° F. even if the ambient temperature is much colder, permitting year-round use of the system. In one embodiment, the size of the band can range widely, so long as the band operates as intended to maintain the temperature of pressurized cannister at a temperature suitable for operation with the system. In one embodiment, heater 64 may resemble a sock that slides over the corresponding pressurized cannister or vessel. As is appreciated by one skilled in the art, the heater may have any geometry and cover any portion of the pressurized cannisters or vessels, so long as the temperature of the pressurized cannisters or vessels can be maintained at a temperature suitable for operation with the system.

The ease of usability allows a person of average skill to operate the system of the present invention with minimal training.

Some immediate advantages provided by the adhesive application system are: Labor Savings (the system provides a much faster way to apply adhesive with fewer people), ease of use (operators can use the system with minimal training or experience), and longevity of the system's life (parts used on the system are weather resistant).

While the invention has been described with reference to one or more embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims. In addition, all numerical values identified in the detailed description shall be interpreted as though the precise and approximate values are both expressly identified.

What is claimed is:

1. An application system for applying a substance over a predetermined surface, comprising:

a frame movable over the predetermined surface;

a pressurized carrier source;

a vessel containing the substance;

a first conduit for conveying the substance from the vessel to at least one nozzle and a second conduit for conveying a pressurized carrier from the pressurized carrier source to the at least one nozzle for applying a mixture of the pressurized carrier and the substance over the predetermined surface; and a cover laterally surrounding the at least one nozzle for minimizing overspray of the mixture, the cover includes a first cover portion and a second cover portion that are moveable with respect to each other;

wherein the frame carries the pressurized carrier source, the vessel, the first conduit, the second conduit, and the cover.

2. The application system of claim 1, wherein the application system is self-contained.

3. The application system of claim 1, wherein the pressurized carrier source is an air compressor.

4. The application system of claim 3, wherein the air compressor is battery powered, powered by a gas source, a liquid source, or a combination thereof.

5. The application system of claim 1 further comprises a plurality of wheels rotatably connected to the frame for permitting movement of the frame over the predetermined surface.

6. The application system of claim 5 further comprises a castor rotatably connected to the frame.

7. The application system of claim 1, wherein the cover is movable relative to the frame between an operating position and a first transport position.

8. The application system of claim 7, wherein the cover is movable relative to the frame between the first transport position and a second transport position.

9. The application system of claim 1, wherein the frame further comprises a handle.

10. The application system of claim 1 further comprises a heater positioned over at least a portion of the vessel for controlling a temperature of the substance.

11. The application system of claim 1 further comprises a control assembly for selectively controlling the flow of the pressurized carrier from the pressurized carrier source to the at least one nozzle.

12. The application system of claim 11, wherein the control assembly includes a control handle movable between an operating position and a shutoff position.

13. The application system of claim 1 further comprises a spray nozzle protector positionable over a portion of each of the at least one nozzle for preserving the at least one nozzle during non-operation of the application system.

14. The application system of claim 1, wherein the predetermined surface is a predetermined horizontal support surface.

15. The application system of claim 13, wherein the substance is a roofing adhesive or a roofing sealant.

16. The application system of claim 13, wherein the cover is movable relative to the frame between an operating position and a first transport position.

17. The application system of claim 16, wherein the cover is movable relative to the frame between the first transport position and a second transport position.

18. The application system of claim 1, wherein the first cover portion is rotated in a first direction and the second cover portion is rotated in a second direction different than the first direction.

19. The application system of claim 1, wherein the first cover portion and the second cover portion are rotated approximately 90 degrees.

20. The application system of claim 1, wherein the first cover portion and the second cover portion are rotated about respective pivotable connections positioned at each of opposed ends of the first and second cover portions.

* * * * *